US011654480B2

(12) United States Patent
Heinrich et al.

(10) Patent No.: US 11,654,480 B2
(45) Date of Patent: May 23, 2023

(54) SLIDING CLOSURE FOR A METALLURGICAL VESSEL, PREFERABLY A DISTRIBUTOR VESSEL FOR A CONTINUOUS CASTING FACILITY

(71) Applicant: Refractory Intellectual Property GmbH & Co. KG, Vienna (AT)

(72) Inventors: Beat Heinrich, Zurich (CH); Thomas Amstutz, Sins (CH)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 113 days.

(21) Appl. No.: 17/255,752

(22) PCT Filed: Apr. 23, 2019

(86) PCT No.: PCT/EP2019/060299
§ 371 (c)(1),
(2) Date: Dec. 23, 2020

(87) PCT Pub. No.: WO2020/001825
PCT Pub. Date: Jan. 2, 2020

(65) Prior Publication Data

US 2021/0268581 A1 Sep. 2, 2021

(30) Foreign Application Priority Data

Jun. 26, 2018 (EP) ..... 18179932

(51) Int. Cl.
*B22D 41/24* (2006.01)
*B22D 41/34* (2006.01)
*B22D 41/40* (2006.01)

(52) U.S. Cl.
CPC ..... *B22D 41/24* (2013.01); *B22D 41/34* (2013.01); *B22D 41/40* (2013.01)

(58) Field of Classification Search
None
See application file for complete search history.

(56) References Cited

U.S. PATENT DOCUMENTS 3,587,945 A 6/1971 Lanatti et al.
3,604,603 A 9/1971 Grosko et al.
3,727,805 A 4/1973 Shapland
(Continued)

FOREIGN PATENT DOCUMENTS

EP 0502185 B1 11/1995
EP 1590114 B1 3/2006
(Continued)

*Primary Examiner* — Scott R Kastler
(74) *Attorney, Agent, or Firm* — Brian Roffe

(57) ABSTRACT

Slide closure for a metallurgical vessel, with two compensation units I and II for equalizing overloads, which may result from the thermal extension and spreading of the fire-proof closure plate thicknesses conditional on manufacturing, and/or from the upper inner shell, wherein the inner shell can also be reduced during operation. The compensation unit I consists of a spring arrangement with fastening screws which can be moved away between the housing and a cover of the housing. The compensation unit II consists, for its part, of a spring arrangement with an insertion frame pressing against the lower closure plate, which insertion frame is fixed to the bottom of the housing with fastening screws.

20 Claims, 3 Drawing Sheets

(56) References Cited

U.S. PATENT DOCUMENTS

| | | | | |
|---|---|---|---|---|
| 3,765,579 | A | 10/1973 | Cramer et al. | |
| 3,921,866 | A | 11/1975 | Palazzo | |
| 3,926,406 | A | 12/1975 | Hind | |
| 4,253,647 | A | 3/1981 | Andres | |
| 4,570,908 | A | 2/1986 | King | |
| 4,697,723 | A | 10/1987 | Fricker | |
| 4,848,604 | A * | 7/1989 | Fricker | B22D 41/24 222/600 |
| 5,011,051 | A | 4/1991 | Kleeblatt | |
| 5,044,533 | A | 9/1991 | King | |
| 5,400,930 | A | 3/1995 | Richard | |
| 5,961,873 | A | 10/1999 | Keller | |
| RE36,364 | E | 11/1999 | Richard | |
| 6,422,435 | B1 | 7/2002 | Toaldo | |
| 10,670,154 | B2 | 6/2020 | Hoffmann | |
| 2006/0049555 | A1 | 3/2006 | Hanse et al. | |
| 2010/0147905 | A1 | 6/2010 | Keller | |
| 2010/0314421 | A1 * | 12/2010 | Ebner | B22D 41/56 222/607 |
| 2017/0259332 | A1 | 9/2017 | Zingre et al. | |
| 2021/0268581 | A1 * | 9/2021 | Heinrich | B22D 41/34 |

FOREIGN PATENT DOCUMENTS

| | | | |
|---|---|---|---|
| EP | 2979778 | A1 | 2/2016 |
| JP | 61159258 | S | 7/1996 |
| WO | 9423867 | A1 | 10/1994 |
| WO | 2020001825 | A1 | 1/2020 |

* cited by examiner

SLIDING CLOSURE FOR A METALLURGICAL VESSEL, PREFERABLY A DISTRIBUTOR VESSEL FOR A CONTINUOUS CASTING FACILITY

FIELD OF THE INVENTION

The invention relates to a slide closure for a metallurgical vessel, preferably a tundish for a strand casting system, with a housing that can be fastened onto the bottom of the vessel, an upper closure plate arranged in a cover of the housing, a lower closure plate and a central closure plate that can be longitudinally displaced between the upper and lower closure plates, and wherein the upper, lower and central closure plates are tensioned against one another with spring arrangements extending between the housing and the cover.

BACKGROUND OF THE INVENTION

Slide closures of this type are known in advance, for example from document EP 0 891 829. They are characterized in that, with them, the flow restriction or closing of the outlet is caused by the longitudinal movement of the slide plate. They thus serve in particular as a positioning member for controlled casting of the quantity of molten material from the metallurgical vessel.

For uninterrupted functioning of the slide closure, the plate tension is set such that it ensures both the free movability of the slide plate and the tightness of the slide closure required to prevent air from being sucked in. However, in operation, plate tension is subjected to additional stresses which result especially due to the thermal extension of the fire-proof plates. There are also stresses due to the likewise fire-proof upper inner shell in the vessel due to its thermal extension or reduction.

OBJECTS AND SUMMARY OF THE INVENTION

The object of the invention is to produce a slide closure of the type named at the outset which absorbs, in optimal manner, the operational stresses of the plate tensioning due to the thermal extension of the closure plates and/or the extension or reduction of the upper inner shell.

This object is achieved according to the invention by providing a slide closure for a metallurgical vessel having a sleeve, with a housing fastenable to a bottom of the vessel and having a cover and an insertion frame, an upper closure plate in the cover of the housing, a lower closure plate in the insertion frame of the housing, and a central, displaceable closure plate longitudinally displaceable between the upper closure plate and the lower closure plate. The slide closure also includes a first compensation unit for tensioning the upper, lower and displaceable closure plates against one another and which includes a first set of spring arrangements that act on a tensile load between the cover and the housing, and a second compensation unit for pressing the upper, lower and displaceable closure plates against the sleeve and which includes a second set of spring arrangements that press the insertion frame in a direction toward the lower closure plate.

An optimal absorption of the fire-proof extensions can be achieved with this first compensation unit with spring arrangements for tightening the closure plates against one another, as well as this second compensation unit with spring arrangements for tightening the closure plates against the upper inner shell with an additional insertion frame, adjustable in the housing, which frame can be pressed against the lower closure plate.

By making the two compensation units interact with one another, both overloads due to the thermal extension of the fire-proof plates and also due to the extension or reduction of the fire-proof inner sleeve are minimized. Unlike the slide closure according to EP 0 891 829, such overloads are thus not limited initially by the rigidity of the fire-proof parts and the metallic slide housing. This is advantageous for the operability or the lifespan of the fire-proof parts of the slide closure.

The invention provides that the spring arrangement of the first compensation unit is composed of plate springs, the pretension of which can be set preferably using a stroke limiting stop of the fastening screws. The plate tensioning can thus be adapted to a broad range of extension of the fire-proof parts which results for thermal reasons or spreading of the fire-proof closure plate thicknesses conditional on manufacturing. The starting pretension of the springs can also be set, in precise and repeatable manner, with the stroke limiting stop.

In so doing, it is expedient if the plate springs transmit the spring stroke via swivel pins, the guides of which are provided with inserts. Wear of these parts is minimized as a result.

The invention also provides that the insertion frame of the second compensation unit is fixed on the bottom of the housing by means of fastening screws arranged in pairs on both sides of the outlet, with plate springs inserted between the screw head thereof and the insertion frame, which springs form the spring arrangement of the second compensation unit. In this way, a uniform load of the insertion frame and thus the lower closure plate can be achieved using means which are simple in design.

In order to ensure that the lower closure plate abuts tightly against the insertion frame satisfactorily, it is expedient to provide a sealing element comprising the outlet between the insertion frame and the housing, which element is inserted preferably in a groove in the housing and/or in the insertion frame.

The slide closure is advantageously provided with a replaceable casting tube which is pressed against the lower closure plate with spring-loaded pressing elements. The pressing elements are expediently arranged such that they are effective independently of the two compensation units of the slide closure. They thus remain operational in all operational phases, both with and without the casting tube.

BRIEF DESCRIPTION OF THE DRAWINGS

The invention is explained in more detail below using an embodiment example, with reference to the drawings. There are shown in.

DETAILED DESCRIPTION OF THE INVENTION

Figure 1:
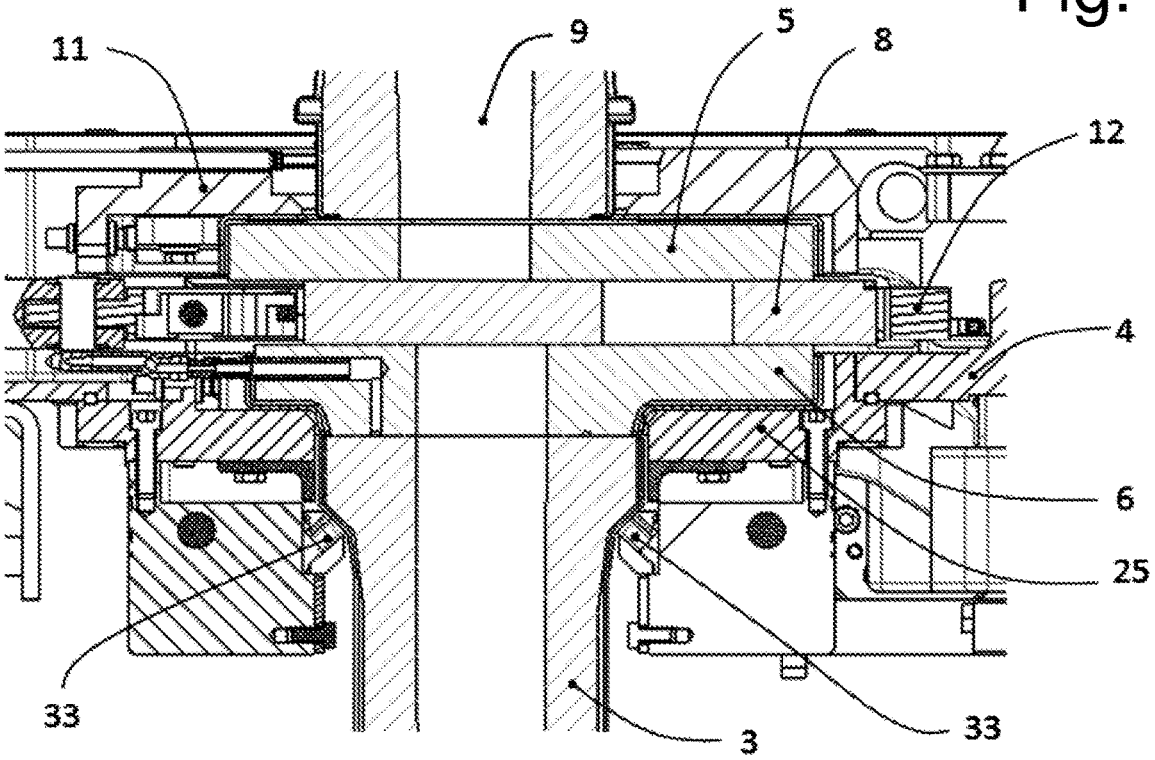
FIG. 1 is a partial longitudinal section of a slide closure according to the invention.

The slide closure according to FIG. 1 can be mounted on the outlet of a metallurgical vessel. The vessel is designed preferably as a tundish of a strand casting system, wherein the slide closure serves to regulate the quantity of molten material supplied to the strand casting ingot mould during the casting process. A casting tube 3 arranged on the bottom of the slide closure makes possible a covered casting of the molten metal into the ingot. However, this slide closure could also be used on a socket, a tap of a converter or the like.

Figure 2:
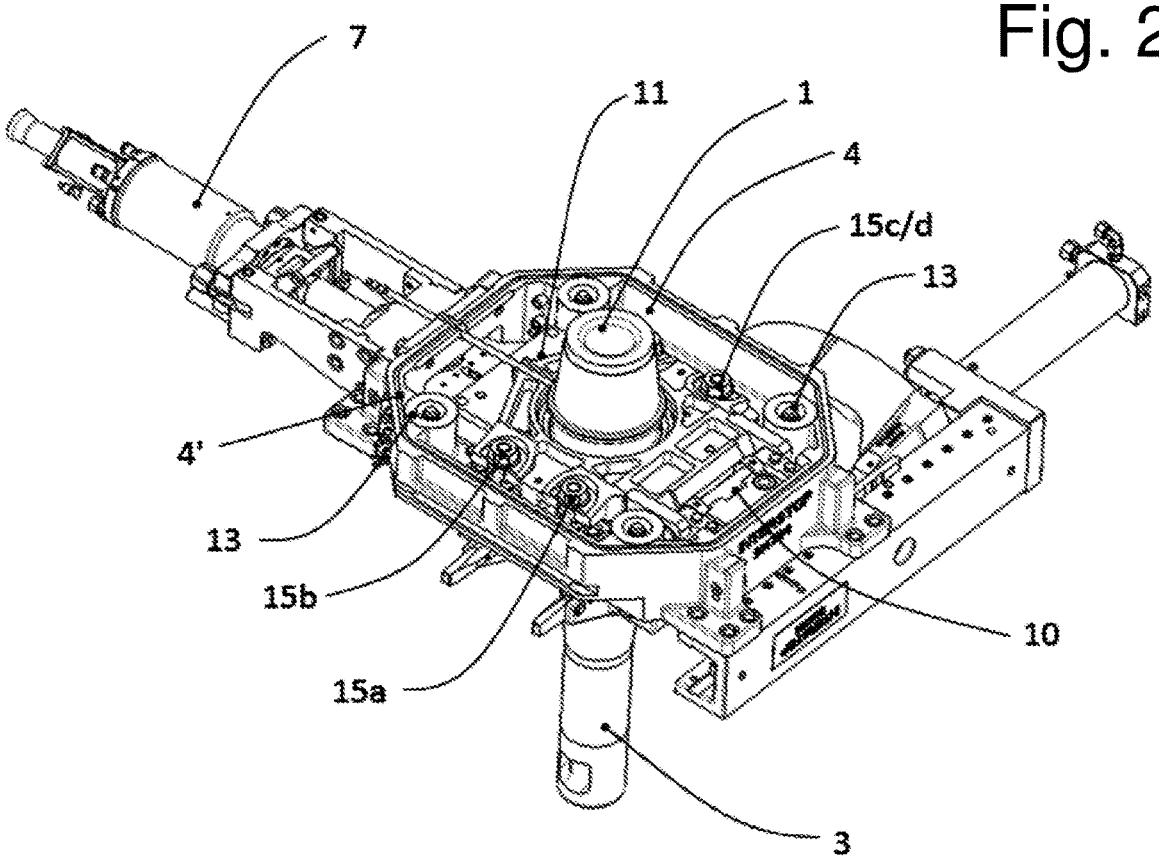
FIG. 2 is a perspective top view of the slide closure according to FIG. 1 on the top thereof which can be fastened to the vessel.

The slide closure according to FIG. 1 and FIG. 2 comprises a housing 4 with a seal 4' arranged all around its upper end surface, in order that it is sealed in encircling manner on its top, at the vessel. Fixed, fire-proof closure plates 5, 6 and a slider plate 8 (also referred to as a movable or displaceable closure plate), which can be moved back and forth therebetween by a drive mechanism 7, can be inserted in the housing 4, with the longitudinal movement of which an opening, restricting or closing of the outlet 9 (which is inside of an upper inner sleeve or sleeve 1) is brought about. The upper closure plate 5 is arranged in a cover 11 of the housing 4, rotatably housed about an axis 10, whereas the lower closure plate 6 is fixed in an insertion frame 25 of the housing 4 and the movable closure plate 8 is fixed in a metal frame 12 coupled to the drive mechanism 7. The casting tube 3 is pressed against the lower closure plate 6 with spring-loaded rockers 33 (also referred to as pressing elements herein). The housing 4 has supports 13 projecting on the top which abut against the outer steel casing of the tundish 2 when in operation.

Figure 3:
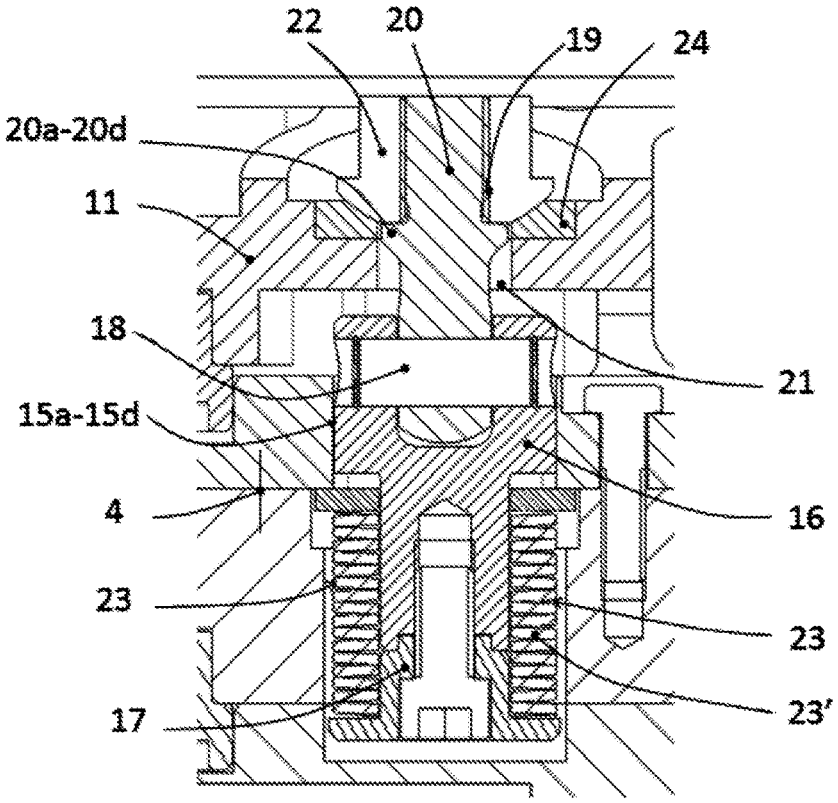
FIG. 3 is a section of a spring arrangement with a tensioning screw, which can be moved away, of the slide closure.

As illustrated in FIG. 3, a spring arrangement 23 has a base 16 guided in the housing 4 with a screw thread 17 and a crossways bolt 18, about which a swivel pin 20 provided with a screw 19 can be swivelled, wherein the swivel pin 20 is guided into a recess 21 of the cover 11 and is screwed into a nut 22 above the cover 11. In order to make possible access to the closure plates 5, 6 and 8, the nuts 22 can be loosened and the swivel pins 20 swivelled out of the recesses 21 of the cover 11. The swivel pins 20 are provided with a stroke limiting stop 20*a* with which the initial pre-stressing of the plate springs 23' acting on tensile load can be set in precise and repeatable manner Inserts 24 in the cover 11 are allocated to the nuts 22 of the fastening screws 15*a*-15*d*, which inserts minimize wear as a consequence of the frequent assembly and disassembly of the screw connections during operation.

During operation, the nuts 22 are screwed so far onto the swivel pins 20 that the closure plates of the slide closure lying between the insertion frame 25 and the cover 11 are tensioned against one another with the respectively provided contact pressure. This contact pressure is such that, during operation, it ensures the uninterrupted movability of the slider plate 8 when the slide closure is fully impermeable to metal or gas from the outside.

During operation, the fire-proof closure plates 5, 6, 8 experience a dispersive mechanical extension of up to 3 millimetres due to heating or manufacturing tolerances, whereby plate tensioning is subjected to an additional stress. According to the invention, this is compensated by a first compensation unit I, because the plate springs 23' of the spring arrangement 23 more or less yield due to the additional stress. The stress compensation is very uniformly distributed over the closure plates in effective manner due to the paired arrangement of the fastening screws 15*a* to 15*d* on both sides of the outlet 1.

Figure 4:
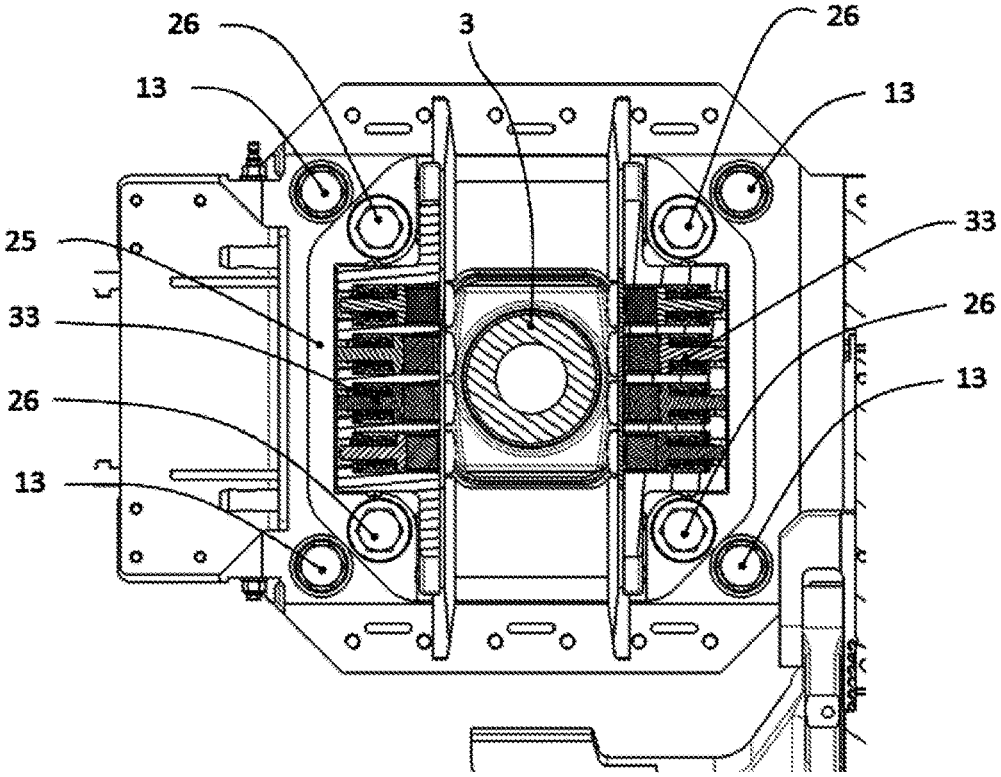
FIG. 4 is a partial view of the slide closure with an insertion frame.
Figure 5:
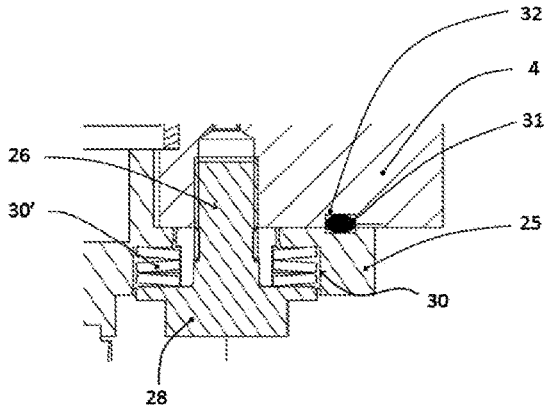
FIG. 5 is a spring member of the slide closure, represented in section.

According to FIG. 4 and FIG. 5, an insertion frame 25 with a spring arrangement 30 is arranged on the bottom of the housing 4 for tensioning the closure plates 5, 6, 8 against the upper inner shell 1 of the outlet. This additional insertion frame 25 is fixed to the housing 4 with fastening screws 26 arranged in pairs on both sides of the outlet.

For its part, the spring arrangement 30 consists of plate springs 30' which are inserted between the screw head 28 of the fastening screws 26 and the insertion frame 25 and have the function of pressing the insertion frame 25 against the lower closure plate 6 abutting against same, and thus tensioning the three closure plates 5, 6, 8 together against the upper inner shell 1 of the outlet.

The additional stress caused by an extension or reduction of the inner shell 1 is compensated with this second compensation unit II formed according to the invention, by the plate springs 30' more or less yielding due to this stress. It is advantageous if these plate springs 30' are produced such that they are provided with a steep characteristic curve in respect of its stroke in relation to the spring force, in order to bring about a relatively high change in force with little lift. This is matched to the corresponding characteristic curves of the plate springs 23' of the compensation unit I, in order that an optimal tensioning is always achieved. In so doing it is intended to be avoided that, depending on the position of the movable closure plate 8, a tipping of the closure plates could take place, wherein this could occur due to an external application of force primarily through the casting tube 3.

Furthermore, to improve the support between the housing 4 and the insertion frame 25, a last, comprehensive sealing element 31 in a groove 32 is approximately half in the housing 4 and approximately half in the insertion frame 25. A labyrinth effect is thus achieved which additionally improves the tightness. The groove could also be designed only in the housing or in the insertion frame.

Figure 6:
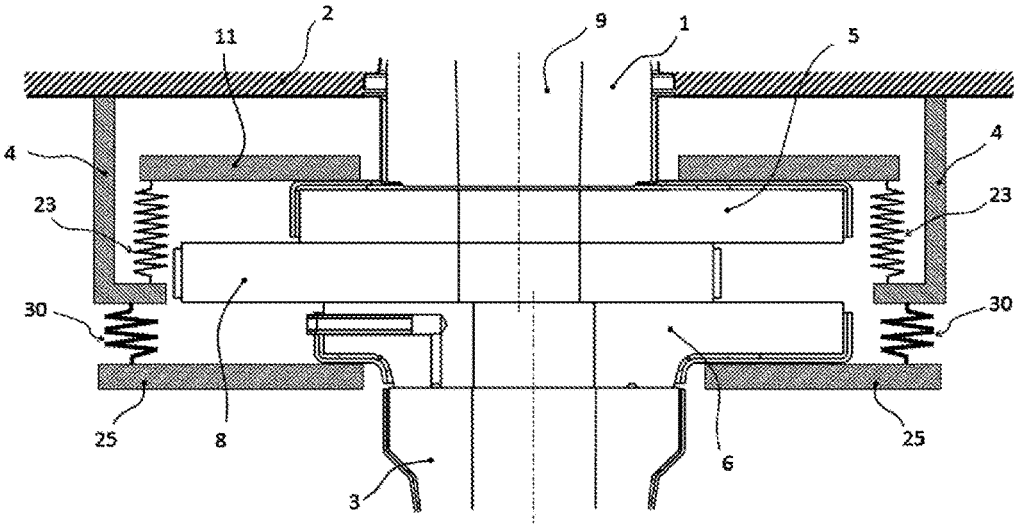
FIG. 6 is a pictorial schematic of the compensation units in the slide closure according to FIG. 1 with a section of the closure plates and partially of the inner sleeve or of the casting tube.

FIG. 6 shows, schematically, the arrangement of the two compensation units I and II in the slide closure. The first compensation unit I is formed by spring arrangements 23 between the cover 11 and the housing 4 acting on tensile load for flexibly tensioning the closure plates 5, 6, 8, because the second compensation unit II is effective due to the spring arrangements 30 between the insertion frame 25 and the housing 4 acting on pressure for tensioning the closure plates 5, 6, 8 against the inner shell 1.

These compensation units can be set independently of one another and are also effective independently of one another, with the result that they can carry out their function both individually and also in combination with one another. As a result, they protect the fire-proof parts of the slide closure against overloads which can result from thermal extension and spreading of the fire-proof closure plate thicknesses conditional on manufacturing and/or of the upper inner shell, wherein the inner shell can also be reduced in operation.

Also, a choice is made to fix the central slider plate 8 in its metal frame 12 with a clamping device 34 such that the function of the compensation units I and II is not impaired by the arrangement thereof in the housing 4.

Figure 7:
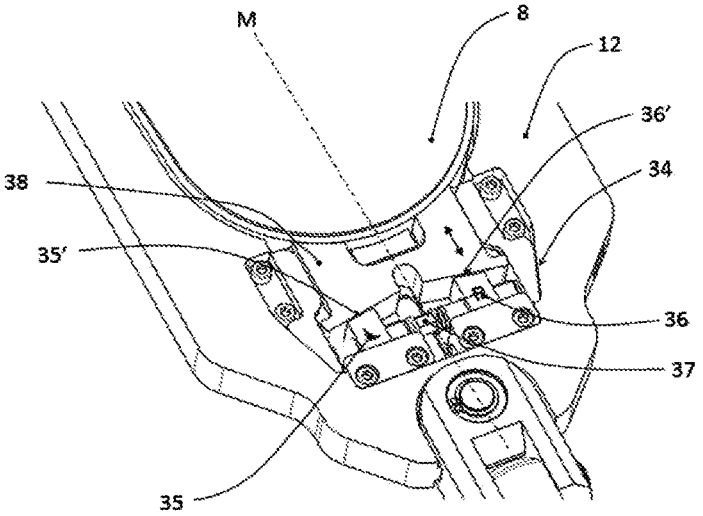
FIG. 7 is a perspective top view on a clamping device for clamping a closure plate in a metal frame of the slide closure according to FIG. 1.

The clamping device 34 according to FIG. 7 is composed of a clamping jaw 38 which can be adjusted against the closure plate 8 in the metal frame 12, two adjusting elements 35, 36 arranged on both sides of the central axis M of the slider plate 8, as well as a threaded spindle 37 abutting against the adjusting elements. The threaded spindle 37 is rotatably housed transverse to the central axis M in the metal frame 12 and provided with thread sections going in opposite directions. By manually rotating this threaded spindle 37, the adjusting elements 35, 36 are adjusted outwards or inwards, symmetrically to one another, and by corresponding wedge surfaces 35', 36' in the adjusting elements 35, 36 or the clamping jaw 38, the latter is pressed against the closure plate 8, with the result that a self-locking wedging is created in order that these do not become loose during operation.

The invention is displayed sufficiently using the above explained embodiment example. Self-evidently, other variants can also be provided. Other springs, such as helical springs or the like, could thus also be used instead of these plate springs 23', 30'.

The invention claimed is:

1. A slide closure for a metallurgical vessel having an upper inner sleeve, comprising:

a housing fastenable to a bottom of the vessel, the housing comprising a cover and an insertion frame, an upper closure plate in the cover of the housing, the upper closure plate being below the upper inner sleeve and having an opening alignable with an outlet of the upper inner sleeve, a lower closure plate in the insertion frame of the housing, the lower closure plate being below the upper closure plate and having an opening, a displaceable closure plate longitudinally displaceable between the upper closure plate and the lower closure plate, the displaceable closure plate having an opening selectively alignable with the opening in the upper closure plate and the opening in the lower closure plate to operatively provide a flow channel from the upper inner sleeve through the lower closure plate, a first compensation unit for tensioning the upper, lower and displaceable closure plates against one another, the first compensation unit comprising a first set of spring arrangements that act on a tensile load between the cover and another part of the housing, and a second compensation unit for pressing the upper, lower and displaceable closure plates in an upward direction toward the upper inner sleeve, the second compensation unit comprising a second set of spring arrangements that press the insertion frame in a direction toward the lower closure plate, and wherein the cover is at a top of the housing and the insertion frame is on a bottom of the housing, the cover and the insertion frame being separate from one another.

2. The slide closure according to claim 1, wherein the first set of spring arrangements extend between the another part of the housing and the cover.

3. The slide closure according to claim 1, wherein the first compensation unit further comprises a fastening screw for each spring arrangement in the first set of spring arrangements, each fastening screw being movable away from the cover.

4. The slide closure according to claim 3, wherein each spring arrangement in the first set of spring arrangements comprises a plurality of plate springs.

5. The slide closure according to claim 4, wherein each fastening screw comprises a stroke limiting stop to enable setting of pretensioning of the plate springs.

6. The slide closure according to claim 4, wherein each fastening screw comprises a swivel pin, the plurality of plate springs of each spring arrangement in the first set of spring arrangements transferring a spring stroke thereof via a respective swivel pin, the first compensation unit further comprising inserts each guiding movement of a respective one of the swivel pins.

7. The slide closure according to claim 1, wherein the insertion frame is fixed on the bottom of the housing.

8. The slide closure according to claim 7, further comprising fastening screws for fixing the insertion frame on the bottom of the housing.

9. The slide closure according to claim 8, wherein the fastening screws are arranged in pairs on both sides of the outlet of the upper inner sleeve.

10. The slide closure according to claim 8, wherein each spring arrangement in the second set of spring arrangements comprises a plurality of plate springs between a screw head of each of the fastening screws and the insertion frame.

11. The slide closure according to claim 1, wherein at least one of the housing and the insertion frame includes a groove facing the other of the housing and the insertion frame, the second compensation unit comprising a sealing element in the groove.

12. The slide closure according to claim 1, further comprising a casting tube and pressing elements that press the casting tube against the lower closure plate.

13. The slide closure according to claim 12, wherein the pressing elements are arranged such that they are operative independently of the first and second compensation units.

14. The slide closure according to claim 1, further comprising a frame including an integrated clamping device that tensions the displaceable closure plate in the frame.

15. The slide closure according to claim 14, wherein the integrated clamping device comprises a clamping jaw adjustable against the displaceable closure plate, two adjusting elements on both sides of a central axis of the displaceable closure plate and a threaded spindle in connection with the displaceable closure plate.

16. The slide closure according to claim 15, wherein the two adjusting elements are adjustable symmetrically to one another by manual rotation of the threaded spindle and the clamping jaw is configured to be pressed against the displaceable closure plate in a self-locking manner by wedge surfaces.

17. The slide closure according to claim 15, wherein the threaded spindle is rotatably housed transverse to a central axis of the frame and includes thread sections in opposite directions for one of the two adjusting elements.

18. The slide closure according to claim 14, wherein the frame is a metal frame.

19. The slide closure according to claim 1, wherein the lower closure plate is fixed in the insertion frame, and a part of the insertion frame is pressed by the spring arrangements in the second compensation unit against the lower closure plate.

20. The slide closure according to claim 1, wherein the second set of spring arrangements is configured to press the insertion frame against the housing.

* * * * *